US005509700A

United States Patent [19]

Kennedy, Jr.

[11] Patent Number: 5,509,700

[45] Date of Patent: Apr. 23, 1996

[54] LATCH AND LOCK FOR TRAILER DOORS

[75] Inventor: Burton K. Kennedy, Jr., Mesa, Ariz.

[73] Assignee: National Security Containers, Inc., Phoenix, Ariz.

[21] Appl. No.: 254,689

[22] Filed: Jun. 6, 1994

[51] Int. Cl.[6] ..... E05C 9/00

[52] U.S. Cl. ..... 292/3; 292/7; 292/40; 292/DIG. 32

[58] Field of Search ..... 292/40, 143, 145, 292/148, DIG. 32, DIG. 68, 42, 267, 7, 3

[56] References Cited

U.S. PATENT DOCUMENTS

| | | | |
|---|---|---|---|
| 918,662 | 4/1909 | Drucker | 292/37 |
| 1,077,091 | 10/1913 | Merritt | 292/DIG. 32 X |
| 2,452,521 | 10/1948 | Johnson et al. | 292/7 |
| 4,269,048 | 5/1981 | McDorman | 70/34 |
| 4,655,059 | 4/1987 | Best et al. | 292/347 X |
| 4,669,767 | 6/1987 | Leto | 292/259 R |
| 4,742,701 | 5/1988 | Scavetto | 70/121 |
| 5,029,909 | 7/1991 | Bunger | 292/40 |
| 5,261,258 | 11/1993 | Bunger | 70/56 |

*Primary Examiner*—Rodney M. Lindsey
*Attorney, Agent, or Firm*—Cahill, Sutton & Thomas

[57] ABSTRACT

A concealed latch for the door of a trailer includes an arm attached to a pivot fastened to the inside of a door on the trailer, a pair of locking bars attached to the arm, and an eyelet or U-shaped metal loop attached to one of the locking bars. One end of the arm is a handle and is more easily broken than the rest of the arm. The bars are attached to the arm on either side of the pivot and extend from the arm to floor or ceiling of the trailer. The door includes an aperture located adjacent the handle portion of the arm to provide access through the outer surface of the door to the arm. When the door is latched, the U-shaped metal loop is positioned adjacent a fixed U-shaped metal loop. A concealed shackle lock covers the two metal loops and fastens the loops together. The aperture in the door is enclosed from the inside to form a recess containing the handle and the lock, protecting them from a vertical blow with a hammer.

11 Claims, 2 Drawing Sheets

LATCH AND LOCK FOR TRAILER DOORS

BACKGROUND OF THE INVENTION

This invention relates to a concealed latch for the doors of a trailer or cargo container and, in particular, to a substantially fully enclosed latch having a frangible handle and a shielded lock.

Cargo containers and truck trailers (herein referred to generically as trailers) are typically equipped with at least one pair of large, hinged doors having vertically sliding bars which engage holes or sockets in the floor and ceiling of the trailer to latch the doors in a closed position. The bars themselves are prevented from moving by a variety of locking devices such as pins, cams, or hasps.

Trailers are used for conveying goods or for temporary storage of goods, such as construction equipment at a job site. Theft is a difficult problem for owners or lessors of trailers, particularly trailers that are used for temporary storage of construction equipment, because the trailer is relatively exposed at night, especially if the trailer remains in the same location for several consecutive nights. Despite secure yards, fences, and locks on the doors of the trailers, thieves manage to overcome security devices and steal valuable goods and equipment. While the ban of chlorofluorocarbon based coolants has temporarily slowed thefts (the coolants were used to freeze the lock, which was then shattered with a hammer), brute force still succeeds in opening the doors of a trailer, e.g. by bending or breaking the exposed latching bars.

The problem of providing a secure latches and locks for trailers has been addressed in the prior art. For example, U.S. Pat. No. 4,742,701 (Scavetto) discloses a mechanism in which a concealed vertical bar has latching elements which pivot into or out of receptacles as the bar is raised or lowered. A lock, the shackle of which is manipulated from outside the trailer by way of a handle, is located in a recess in a door. U.S. Pat. No. 4,669,767 (Leto) discloses a trailer with rear doors having an exposed latch and a concealed bar inserted and locked in place from a side of the trailer. U.S. Pat. No. 2,452,521 (Johnson et al.) discloses an exposed door latch in which a pair of vertical bars are attached to a pivoting plate. A handle is also attached to the plate for rotating the plate and latching or unlatching the doors. In the latched position, a U-shaped metal loop attached to one of the bars extends through a slot in the handle for receiving the shackle of a lock.

Enclosed latches and locks of the prior art are complicated structures which are expensive to make and not particularly rugged or easy to use. Exposed latches and locks are subject to brute force attack in which the latching bars are bent. A lock on one side of a trailer and a latch on another side of the trailer are not convenient to use.

In view of the foregoing, it is therefore an object of the invention to provide an enclosed, mechanically simple, rugged latch for trailers.

Another object of the invention is to provide a concealed latch and lock for trailers in which the exposed portion of a handle for operating the latch breaks more easily than the rest of the latch and lock.

A further object of the invention is to provide a latch and lock for trailers in which only a handle for operating the latch is vulnerable to attack and the handle is frangible.

SUMMARY OF THE INVENTION

The foregoing objects are achieved in the invention in which a concealed latch for the door of a trailer includes an arm attached to a pivot fastened to the inside of a door on the trailer, a pair of locking bars attached to the arm, and an eyelet or U-shaped metal loop attached to one of the locking bars. One end of the arm is a handle and is more easily broken than the rest of the arm. The bars are attached to the arm on either side of the pivot and extend from the arm to floor or ceiling of the trailer. The door includes an aperture located adjacent the handle portion of the arm to provide access through the outer surface of the door to the arm. When the door is latched, the U-shaped metal loop is positioned adjacent a fixed U-shaped metal loop. A concealed shackle lock covers the two metal loops and fastens the loops together. The aperture in the door is covered from the inside to form a recess containing the handle, the eyelets, and the lock, protecting them from a vertical blow with a hammer.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
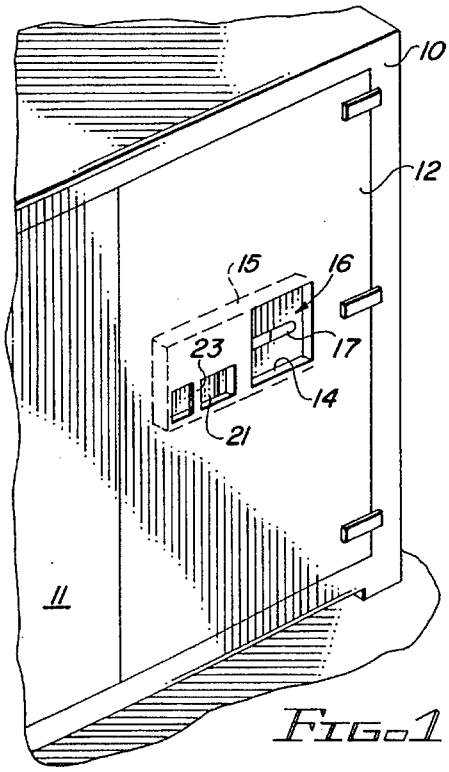
FIG. 1 illustrates a trailer having a concealed latch constructed in accordance with the invention.

In FIG. 1, trailer 10 includes doors 11 and 12 which fit together upon closing such that door 12 holds door 11 in place and a single latch is sufficient for holding both doors in a closed position. A cane lock (not shown) is preferably included on the inside of door 11 for separately latching door 11. The cane lock fits into a socket in the floor of trailer 10.

The outer surface of door 12 includes aperture 14 having enclosure 15 positioned behind the aperture to form recess 16. Enclosure 15 is a rectangular steel box having one side open and the edges thereof abutting the inside of door 12 about aperture 14. The open side is preferably larger than aperture 14 and enclosure 15 is preferably welded to door 12. Handle 17 extends into recess 16 adjacent aperture 14, through which the handle is accessible from outside trailer 10.

Door 12 includes second recess 21 containing eyelets for receiving a lock. The function of the eyelets is more fully described in conjunction with FIGS. 3–9. Spanning recess 21 is grab handle 23. Handle 23, positioned near the junction of doors 11 and 12, facilitates opening and closing door 12 and is frangible, preferably being welded along only the outer edge at each end thereof.

Figure 2:
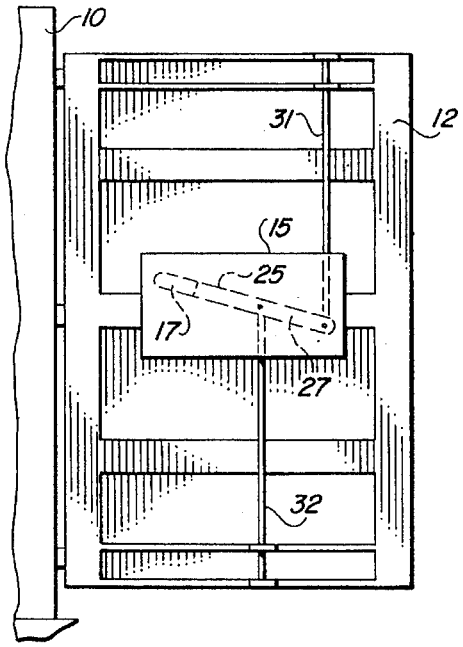
FIG. 2 is an inside view of a door of the trailer, showing the concealed latch.

FIG. 2 illustrates the inside of door 12 and of enclosure 15 containing arm 25 and pivot 27. Handle 17 is part of arm 25 which is attached to enclosure 15 by pivot 27. Arm 25 rotates about pivot 27 in a plane approximately parallel to door 12. Bar 31 and bar 32 are attached to arm 25 with pivot 27 between them and are preferably equidistant from the pivot. As illustrated in FIG. 2, arm 25 is in the unlatched position in which bar 32 is raised and bar 31 is lowered. Door 12 is latched shut by lowering handle 17 which rotates arm 25 counterclockwise about pivot 27. Arm 25 raises bar 31 to engage a hole or socket in the sealing of trailer 10 and lowers bar 32 to engage a socket in the floor of the trailer.

Bars 31 and 32 pass through holes in the walls of enclosure 15 and are preferably steel bars having a diameter of 0.75 inches or larger. Suitable guides are attached to the inside of door 12 and bars 31 and 32 slide through the guides to engage sockets in the floor and ceiling of the trailer. The sockets preferably include sleeves of steel pipe for reinforcing the holes in the floor of Bars 31 and 32 are attached to arm 25 by a rotating joint, e.g. a pin or bolt through the ends of the bars and through holes in arm 25.

Figure 3:
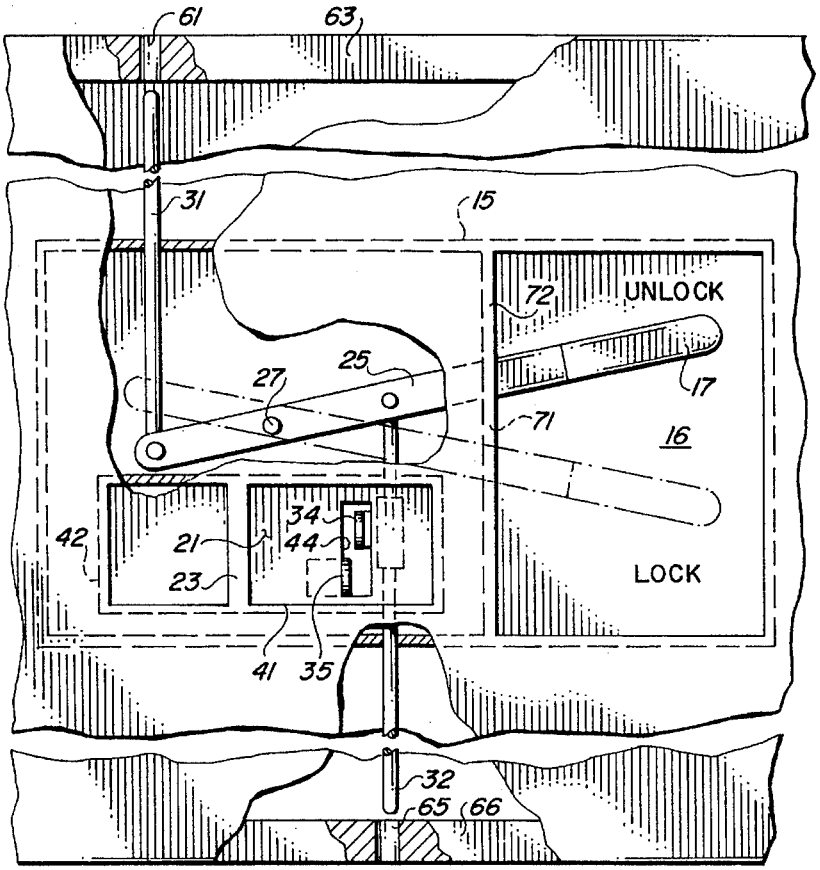
FIG. 3 is a cut-away view of a concealed latch constructed in accordance with the invention.
Figure 4:
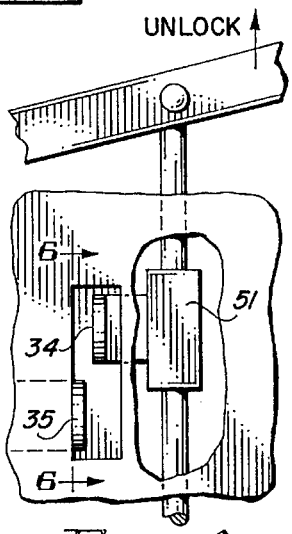
FIG. 4 is a front view showing the alignment of eyelets when the latch is open.

FIG. 3 illustrates the locking mechanism for the latch in which movable eyelet 34 is attached to bar 32 and fixed eyelet 35 is attached to enclosure 42. Eyelets 34 and 35 can be U-shaped rods of metal, small iron or steel doughnuts, or flat bar stock having holes drilled through the stock. Aperture 41 in door 12 is adjacent eyelets 34 and 35. Enclosure 42 is a rectangular steel box having one side open and the edges thereof abutting the inside of door 12 about aperture 41 to form recess 21. The open side is preferably larger than aperture 41 and enclosure 42 is preferably welded to door 12. Enclosure 42 fits within enclosure 15 and includes slot 44 through which eyelets 34 and 35 extend for access from outside trailer 10.

As illustrated in FIG. 3, door 12 is not latched and eyelets 34 and 35 are separated along the length of slot 44 such that a single bolt or shackle could not pass through both eyelets. Eyelet 34 (FIGS. 4,6,8) is preferably a piece of bent flat bar stock having hole 50 (FIG. 6) for receiving a shackle or bolt. Eyelet 34 is welded to collar 51 (FIGS. 4,6) which, in turn, is welded to bar 31. Eyelet 35 is also a piece of flat bar stock having hole 55 (FIGS. 6,7) for receiving a shackle or bolt. The bar stock is bent at a right angle and attached to the rear of enclosure 42, preferably by welding as indicated by weld 59 in FIG. 8. Eyelet 34 moves with bar 31 and eyelet 35 is fixed.

In FIG. 3, which is a view of the outside of door 12, arm 25 rotates about pivot 27 to raise or lower bars 31 and 32. FIG. 3 illustrates the latch mechanism in an unlatched position with bar 31 positioned below socket 61 in roof 63 and bar 32 positioned above socket 65 in floor 66. Arm 25 extends through slot 71 in wall 72 and terminates in handle 17. Handle 17 can be a portion of arm 25 which is reduced in thickness or otherwise weakened to assure that handle 17 can be separated from the remainder of arm 25. For example, handle 17 can include a plastic member attached to the end of arm 25 or can be a portion of arm 25 separated from the remainder of arm 25 by a scored or weakened region.

Arm 25 is preferably made from flat bar stock having a length and width approximately parallel to the plane of the door. The thickness of the bar stock is therefore perpendicular to the plane of the door and handle 17 is stronger for vertical loads, i.e. actuating the latch, than for horizontal loads, e.g. someone attempting to pry or otherwise force the handle. Handle 17 is shielded within recess 16 and attempts to pry or force the handle will necessarily include a horizontal component. This horizontal component provides the force for breaking handle 17 and distinguishes normal operation of the handle from an attempted break-in.

Figure 5:
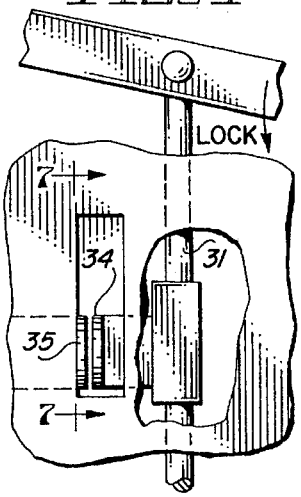
FIG. 5 is a front view showing the alignment of eyelets when the latch is closed.
Figure 6:
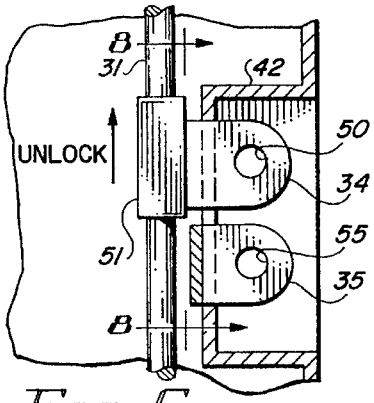
FIG. 6 is a side view showing the alignment of eyelets when the latch is open.
Figure 7:
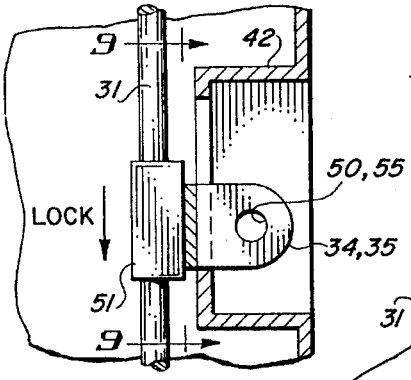
FIG. 7 is a side view showing the alignment of eyelets when the latch is closed.
Figure 9:
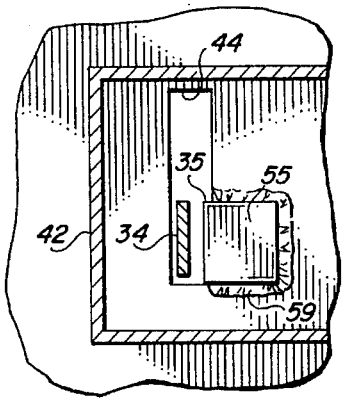
FIG. 9 is a rear view showing the alignment of eyelets when the latch is closed.

As handle 17 is moved vertically downward (FIG. 3), arm 25 rotates clockwise about pivot 27, bar 31 is raised into socket 61 and bar 32 is lowered into socket 65. As illustrated in FIGS. 5, 7, and 9, eyelets 34 and 35 are aligned in the latch position and a shackle or locking pin can be passed through holes 50 and 55 in eyelets 34 and 35.

Figure 10:
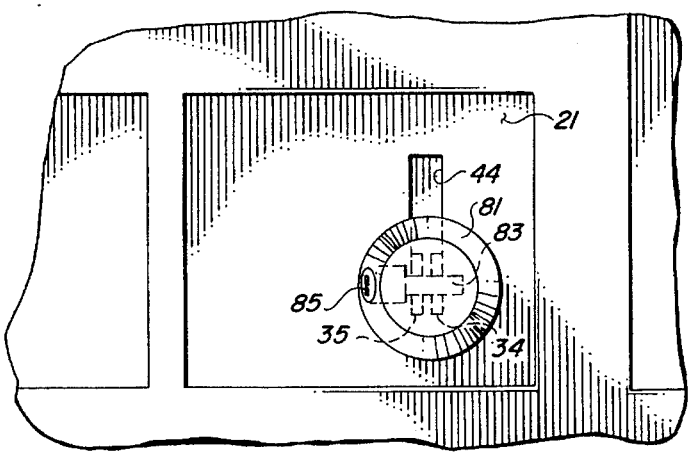
FIG. 10 is a front view of the latch with a lock in place over the eyelets.
Figure 11:
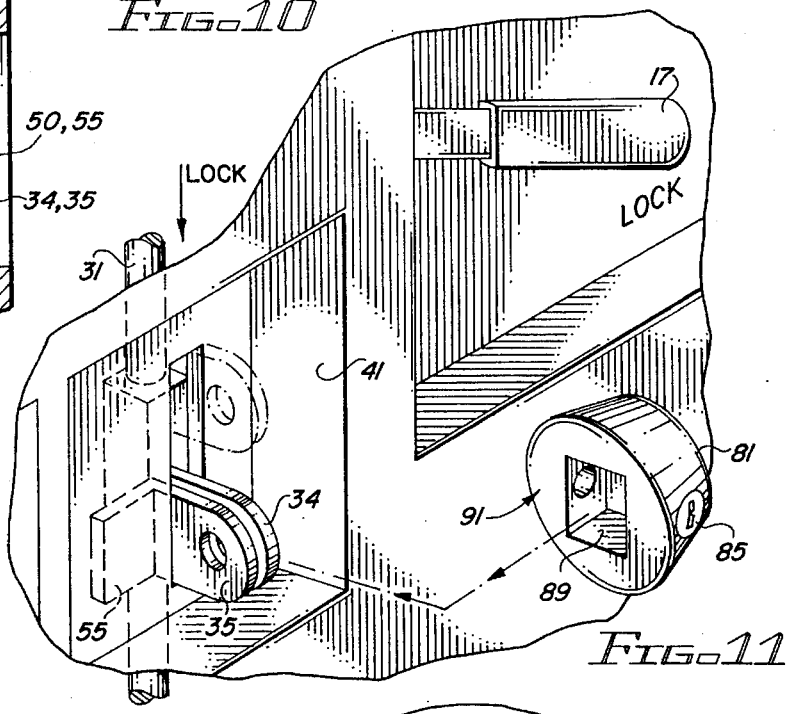
FIG. 11 shows the assembly of the latch and lock.
Figure 8:
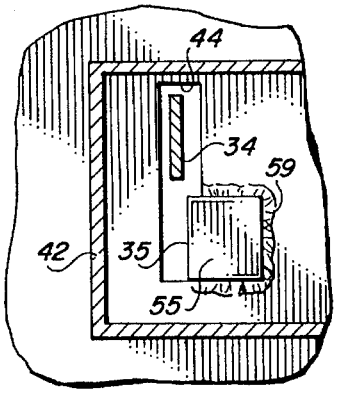
FIG. 8 is a rear view showing the alignment of eyelets when the latch is open.

FIGS. 10 and 11 illustrate a preferred form of lock for use with the invention in which the lock includes a concealed shackle within a relatively massive body. As illustrated in FIG. 10, lock 81 includes shackle 83 actuated by lock mechanism 85. Shackle 83 is extended through eyelets 34 and 35 by operation of a key in locking mechanism 85. The body of lock 81 includes recess 89 (FIG. 11) which encloses eyelets 34 and 35. Lock 81 is preferably in the shape of the frustum of a cone and includes a flat lower surface 91 which fits against the inner surface of recess 21. The height or thickness of lock 81 (the height of the frustum) is preferably less than the depth of recess 21, thereby preventing vertical access to the lock and protecting the lock from strong shearing forces as can be applied by striking the lock with a hammer.

The invention thus provides a substantially fully enclosed latch and lock in which the exposed portion of a handle is easily broken if subjected to abuse and the lock is shielded from direct blows which could shear the lock. The latch is easily and inexpensively constructed and there is more than sufficient access to the lock within recess 21 for normal operation of the lock. The lock is located near the handle, and on the same side of the trailer as the handle, to facilitate the operation of the latch and lock.

Having thus described the invention, it will be apparent to those of skill in the art that various modifications can be made within the scope of the invention. For example, handle 17 can be made from a soft metal or plastic which bends or deforms rather than breaks yet transmits enough force to actuate the latch without deformation or bending. Handle 17 can be attached to arm 25 by a frangible joint. It is preferred that at least a stub from arm 25 be accessible from recess 16 for operating the latch even after an attempted break-in.

What is claimed is:

1. A latch for a door on a trailer, said latch located on the inside of said door and comprising:

a pivot attached to the inside of said door;

an arm having a first end and a second end, said arm attached to said pivot between said ends and rotating about said pivot in a plane approximately parallel to said door;

a first locking bar attached to said arm;

a second locking bar attached to said arm, wherein said pivot is between said first locking bar and said second locking bar;

a handle attached to said arm for rotating said arm about said pivot in a plane substantially parallel to said door, wherein said door includes an aperture adjacent said handle for providing access to said handle from the outside of said door and said handle is frangible and breaks when moved out of said plane.

2. The latch as set forth in claim 1 wherein said latch further comprises a first rectangular enclosure having six sides, wherein one side is open and the edges of the open side abut the inside of said door about said aperture.

3. The latch as set forth in claim 2 wherein said one side is larger than said aperture said enclosure contains said pivot and said arm.

4. The latch as set forth in claim 3 wherein said latch includes a movable eyelet attached to said first locking bar and a fixed eyelet and said door includes a second aperture adjacent said movable eyelet and said fixed eyelet for providing access from outside said door to said movable eyelet and said fixed eyelet, wherein said movable eyelet is aligned with said fixed eyelet when said latch is closed.

5. The latch as set forth in claim 4 wherein said latch further comprises a second rectangular enclosure having six sides, wherein one side is open and the edges of the open side abut the inside of said door about said second aperture;

said one side is larger than said second aperture;

a side opposite said one side includes a slit through which said fixed eyelet and movable eyelet extend into the interior of said second enclosure.

6. The latch as set forth in claim 5 wherein said second enclosure is within said first enclosure.

7. The latch as set forth in claim 1 wherein said latch includes a movable eyelet attached to said first locking bar and a fixed eyelet and said door includes a second aperture adjacent said movable eyelet and said fixed eyelet for providing access from outside said door to said movable eyelet and said fixed eyelet, wherein said movable eyelet is aligned with said fixed eyelet when said latch is closed.

8. The latch as set forth in claim 7 wherein said latch further comprises an enclosure having at least two sides, wherein one side is open and the edges of the open side abut the inside of said door about said second aperture;

said one side is larger than said second aperture;

a side opposite said one side includes a slit through which said fixed eyelet and said movable eyelet extend into the interior of said enclosure.

9. A trailer having doors which can be latched and locked, wherein at least one door comprises:

a latch located on the inside of said door;

a recess in the outside of said one door; and a handle in said recess for actuating said latch, wherein said handle rotates in a plane parallel with said door and is frangible and breaks when moved out of said plane.

10. The trailer as set forth in claim 9, wherein said handle is made from flat stock having a length and a width approximately parallel to the plane of said door and a thickness approximately perpendicular to the plane of said door.

11. The trailer as set forth in claim 9 and further comprising:

a second recess in said door;

a fixed eyelet located in said second recess;

a movable eyelet located in said second recess;

wherein said movable eyelet is aligned with said fixed eyelet when said latch is closed; and a concealed shackle lock for engaging said fixed eyelet and said movable eyelet.

* * * * *

UNITED STATES PATENT AND TRADEMARK OFFICE

CERTIFICATE OF CORRECTION

PATENT NO. : 5,509,700
DATED : April 23, 1996
INVENTOR(S) : Kennedy

It is certified that error appears in the above-identified patent and that said Letters Patent is hereby corrected as shown below:

Title page,
Item [75], Inventor, the co-inventor -- Mr. Roger R. Shumway, 15073 W. Fairmont, Goodyear, AZ 85338 -- should be added thereto.

Signed and Sealed this

Eleventh Day of November, 2003

JAMES E. ROGAN
*Director of the United States Patent and Trademark Office*